United States Patent [19]

Vollinger

[11] 3,957,391

[45] May 18, 1976

[54] TURBINE COOLING

[75] Inventor: Gary J. Vollinger, Simsbury, Conn.

[73] Assignee: United Technologies Corporation, Hartford, Conn.

[22] Filed: Mar. 25, 1975

[21] Appl. No.: 561,713

[52] U.S. Cl. ..... 415/116; 415/136; 415/217

[51] Int. Cl.[2] ..... H01D 5/18

[58] Field of Search ..... 415/115, 116, 117, 136, 415/137, 138, 217

[56] References Cited

UNITED STATES PATENTS

| | | | |
|---|---|---|---|
| 2,427,244 | 9/1947 | Warner | 415/136 |
| 3,423,071 | 1/1969 | Noren | 415/217 |
| 3,781,125 | 12/1973 | Rahaim | 415/217 |
| 3,836,279 | 9/1974 | Lee | 415/115 |

FOREIGN PATENTS OR APPLICATIONS

| | | | |
|---|---|---|---|
| 200,056 | 11/1955 | Australia | 415/217 |
| 641,144 | 8/1950 | United Kingdom | 415/217 |
| 248,891 | 7/1970 | U.S.S.R. | 415/217 |
| 1,213,423 | 3/1966 | Germany | 415/217 |

*Primary Examiner*—Henry F. Raduazo
*Attorney, Agent, or Firm*—Robert C. Walker

[57] ABSTRACT

Apparatus for cooling the case and the nozzle guide vanes in the turbine section of a gas turbine engine is disclosed. A plurality of guide vanes is cantilevered from the case and extends radially inward across the path of working medium gases flowing through the turbine. A ring, which is deformable to provide radial sealing in operative response to pressure forces exerted by medium gases on the airfoil section of each guide vane, is disposed between the vanes and the case forming an annular chamber which is adapted to receive cooling air and from which the cooling air is flowable to the vanes during operation of the engine.

3 Claims, 3 Drawing Figures

TURBINE COOLING

BACKGROUND OF THE INVENTION

1. Field of the Invention

This invention relates to gas turbine engines and more particularly to apparatus for cooling the case and the nozzle guide vanes in the turbine section of the engine.

2. Description of the Prior Art

A limiting factor in many turbine engine designs is the maximum temperature of the working medium gases that can be tolerated at the inlet to the turbine. A variety of techniques is used to increase the allowable inlet temperature including the cooling of the first few sets of nozzle guide vanes and rotor blades. Such cooling is commonly accomplished with air bled from the compressor and transferred to a local area to be cooled through suitable conduit means. The cooling air is at a pressure which is sufficiently high to permit the air to flow into the local area of the turbine without auxiliary pumping and at a temperature sufficient to provide the required cooling.

Impingement cooling is one of the more effective techniques used in cooling the turbine. In this type of cooling relatively high pressure air is passed through a multiplicity of orifices in a plate which is adjacent to the surface to be cooled causing jets of air to impinge upon local areas of the surface. The cooling rate in any local area is higher than that obtainable with conventional convective cooling thereby permitting exposure of the cooled components to higher gas temperatures without adversely effecting their durability.

Sufficiently high impingement velocities are obtainable with pressure differentials of the cooling air across the plate which are typically within the range of 20 to 70 pounds per square inch. Because of the substantial pressure differential a continuing problem in such constructions is the premature leakage of cooling air from the supply conduit means before the air can be discharged against the part to be cooled.

Considerable technical effort has been directed to the design of coolable components which minimize the potential for cooling air leakage. In U.S. Pat. No. 3,362,681 to Smuland apparatus which isolates the cooling flow to the nozzle guide vanes in the turbine section of an engine is shown. An arcuate plenum chamber is formed at the base of a plurality of integrally formed guide vanes. Cooling air supplied to the chamber is flowed to each of the vanes in the unit to cool the respective vane. The substantial premature leakage of cooling air between platforms of adjacent vanes is eliminated by the integrally formed construction of Smuland. In an engine, however, the vanes are exposed to extremely hot local gases which cause the blades to wear and ultimately require that the blades be periodically replaced. When this happens the integrally formed construction is unattractive as compared to a vane construction which permits the replacement of each vane individually according to local wear and deterioration.

In order to take advantage of the maintenance features of the individual vane construction, means must be devised to prevent the premature leakage of cooling air between the adjacent vanes. Numerous attempts have been made in the past to establish a mechanical seal between the vanes at that location but they have been only partially effective in reducing the amount of leakage. The amount of cooling flow lost across the mechanical seal increases substantially in proportion to the pressure differential between the cooling air supply and the local working medium gases. It is apparent that where impingement cooling techniques are utilized this pressure differential will be great and the associated losses will be significant.

Another limiting factor in many turbines is the radial clearance between the tips of the rotor blades and the opposing outer air seal which is supported by the turbine case. The clearance is made as small as possible to reduce the leakage of working medium gases around the tips from the pressure side to the suction side of each blade, but yet large enough to accommodate the thermal growth of the rotor. Because the rotor responds much faster to increased working medium temperatures than the case which supports the seal, a relatively large initial clearance is provided to prevent the destructive impact of the blade tips on the seal. The minimum clearance between the tips and the seal occurs when the rotor and the blades mounted thereon have expanded thermally ahead of the case. Once the case also responds, the clearance becomes increased and substantial leakage occurs.

In many engines cooling air is flowed through chambers adjacent to the case to limit the thermal response of the case and, accordingly, to minimize the clearance under steady state conditions. The chambers are positioned radially between the flow path of the working medium gases and the case and, in most embodiments, contain cooling air at a pressure greater than the local pressure of the medium gases. In order to make judicious use of the cooling air, radial seals between the cooling air and the medium gases must be maintained.

Overall engine performance can be increased by reducing the amount of cooling flow. Accordingly, continuing efforts are underway to treat the problem of cooling air leakage in an effective manner while maintaining or increasing the standards of component durability.

SUMMARY OF THE INVENTION

A primary object of the present invention is to improve the performance and durability of a gas turbine engine through judicious use of cooling air to the case and the guide vanes of the turbine section.

According to the present invention, an air chamber is formed in a gas turbine engine between the case and an annular ring which is located radially outward of a row of nozzle guide vanes and is deformable against a supporting surface, in operative response to pressure forces exerted on the vanes by working medium gases flowing through the engine, to maintain an air seal between the chamber and the medium gases.

In accordance with one specific embodiment, a plurality of platform cavities which are at relatively low pressure and airfoil cavities which are at relatively high pressure are alternately formed circumferentially about the engine at a position radially inward of the air chamber; the ring deforms during operation of the engine against ribs which extend from each guide vane in an axially oriented direction.

A principal feature of the present invention is the ring which is trapped between the turbine case and the vanes to form a cooling air chamber. In one embodiment flow metering orifices in the ring communicatively join the chamber to the platform and airfoil cavities which are alternately disposed circumferentially about the engine at the base of the vanes. The cavities are formed by a pair of axial sealing ribs which extend from each vane to the ring. The metering orifices are sized to provide relatively low pressure air to the platform cavities and relatively high pressure air to the airfoil cavities during operation of the engine. Another feature of the present invention is the hooks which extend from each vane to engage the upstream portion of the ring. During operation of the engine the working medium gases exert pressure forces on the vane which tend to rotate the vane about its downstream attachment and cause the hooks to deform the upstream portion of the ring against its supporting surface.

A principal advantage of the present invention is a reduction in the loss of cooling air due to leakage between the ring and its supporting structure. In one embodiment the loss of cooling air due to leakage between the platforms of adjacent vanes is also reduced. The pressure of the air in the cavity beneath the platforms is only slightly above the pressure of the working medium but is sufficient to prevent the circulation of working medium gases below the vane platforms. Higher pressure cooling air is confined to airfoil cavities where a substantial flow of air at elevated pressures is required to cool the vane.

The foregoing, and other objects, features and advantages of the present invention will become more apparent in the light of the following detailed description of the preferred embodiment thereof as shown in the accompanying drawing.

DETAILED DESCRIPTION OF THE PREFERRED EMBODIMENT

Figure 1:
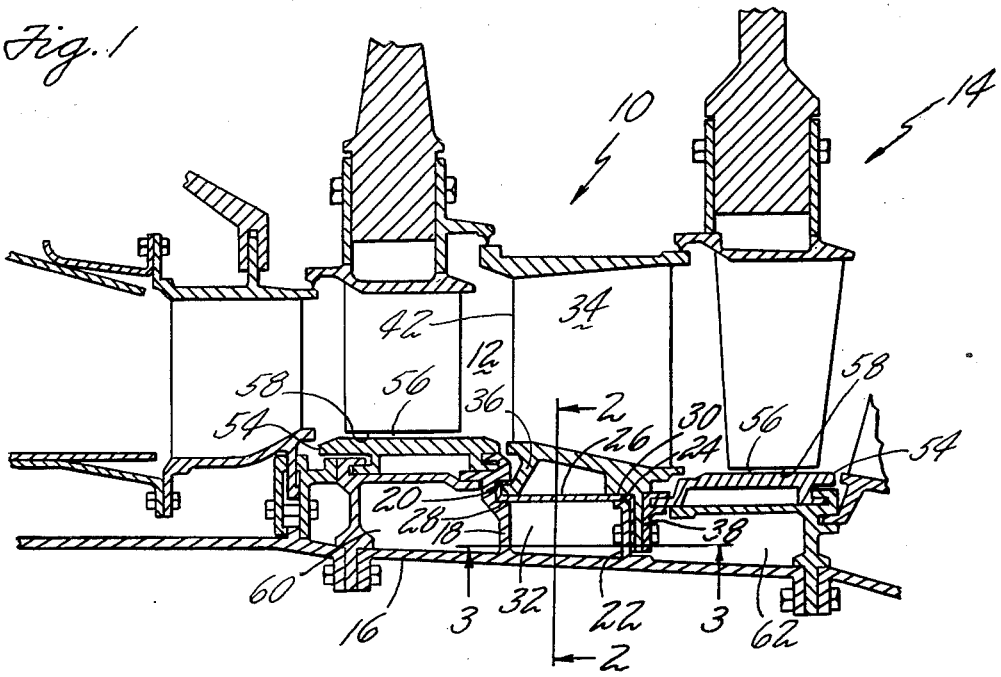
FIG. 1 is a cross-sectional view of a portion of the turbine section of a gas turbine engine showing a coolable nozzle assembly.

A portion of a gas turbine engine is shown in cross section in FIG. 1. A turbine nozzle assembly 10 is disposed within the working medium flowpath 12 immediately upstream of a wheel assembly 14. The nozzle assembly includes a turbine case 16 which has extending therefrom an upstream internal rail 18 including an outwardly facing circumferential surface 20 and a downstream internal rail 22 including an inwardly facing circumferential surface 24. A ring 26 which is deformable and has a U-shaped upstream portion 28 engages the circumferential surface 20 of the upstream rail. A downstream portion 30 of the ring 26 concentrically opposes the circumferential surface 24 of the downstream rail. The case 16 and the ring 26 define a cooling air chamber 32 located therebetween. A nozzle guide vane 34 has an arcuate hook 36 which engages the upstream rail 18 and a downstream flange 38 which is attached to the downstream rail 22. A plurality of guide vanes 34 are circumferentially disposed inward of the case at the location shown completing the construction of the nozzle assembly 10.

Figure 3:
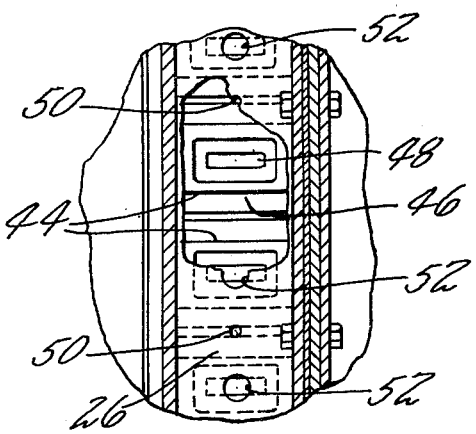
FIG. 3 is a sectional view taken along the line 3—3 as shown in FIG. 1 which is partially broken away to show the undersides of the nozzle guide vanes.
Figure 2:
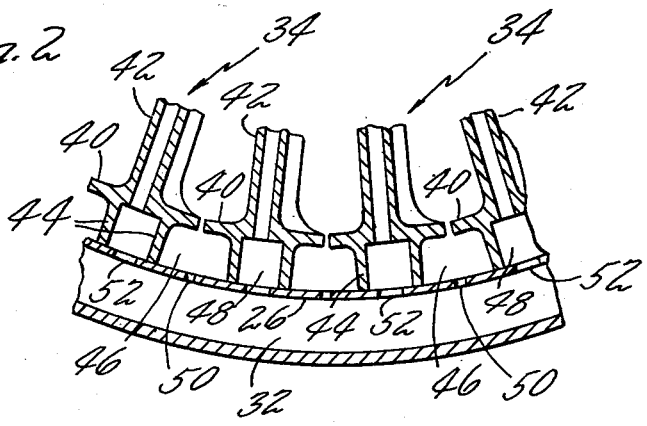
FIG. 2 is a sectional view taken along the line 2—2 as shown in FIG. 1.

As is shown in FIG. 2 each vane has a platform section 40 and an airfoil section 42. A pair of ribs 44 extend radially between each vane platform section 40 and the deformable ring 26 and form an airfoil cavity 48. Between each pair of adjacent vanes is a platform cavity 46. The deformable ring 26, as is shown in FIG. 2 and in FIG. 3, has a plurality of platform orifices 50 and a plurality of airfoil orifices 52 which communicatively join the platform and the airfoil cavities respectively to the air chamber 32.

The turbine case 16 controls the radial position of the outer air seals 54 which are supported therefrom. A radial clearance 56 separates each seal from the opposing blade tip 58. The clearance is made as small as possible to reduce the leakage of working medium gases around the tips from the pressure side to the suction side of each blade, but yet large enough to accommodate the thermal growth of the rotor. Because the rotor responds much faster to increased working medium temperatures than the case which supports the seal, a relatively large initial clearance is provided to prevent the destructive impact of the blade tips on the seal. The minimum clearance between the tips and the seal occurs when the rotor and the blades mounted thereon have expanded thermally ahead of the case. This minimum clearance is maintained in the present embodiment by cooling the turbine case to reduce the magnitude of its thermal response.

Relatively cool air is flowed to the air chamber 32 as well as the upstream chamber 60 and the downstream chamber 62. The leakage of air from the chamber 32 around the upstream portion 28 of the ring 26 is prevented by sealing contact between the upstream portion and the opposing circumferential surface 20 of the upstream rail 18.

Sealing contact between the upstream portion of the ring is maintained with the surface by pressure forces exerted by the working medium on the vane airfoil sections 42, which tend to rotate the vanes about the downstream rail 22 during operation of the engine. Rotation urges the hooks 36 radially inward deforming the ring against the surface 20. Although, the ring is shown in conjunction with guide vane cooling, it should be recognized by one skilled in the art that the concepts and apparatus employed are equally applicable at any vane stage for forming a cooling chamber between the vanes of that stage and the turbine case.

The air chamber 32 has an annular shape which extends circumferentially about the centerline of the engine. Cooling air is supplied to the chamber by conduit means which are not shown. One common source of the cooling air is the exit region of the compressor where the air is at a sufficiently high pressure to be flowable into the turbine. In such an embodiment the pressure of the cooling air and the pressure of the working medium gases at the leading edge of the vane during takeoff are on the order of 210 and 165 pounds per square inch absolute respectively.

The deformable ring 26 radially separates the chamber 32 from the platform cavities 46 and the airfoil cavities 48 which are alternately spaced about the inner circumference of the chamber. As the chamber is pressurized the ring deforms against the ribs 44 to establish an air seal between adjacent platform and airfoil cavities. Although the ring may be segmented in some embodiments, a full ring eliminates the possibility of air leakage between adjacent segments and is preferred. In one embodiment the ring has a plurality of airfoil orifices 52 and platform orifices 50 which communicatively join the airfoil cavities and platform cavities respectively to the chamber. A ring formed from sheet metal having a thickness within the range of 0.015 to 0.025 of an inch may be used depending upon the pressure differential across the ring. In one embodiment the pressure differential and the ring thickness are approximately 10 pounds per square inch and 0.017 of an inch respectively.

Each airfoil cavity 48 extends radially into the airfoil section 42 of the respective nozzle guide vane 34. The cooling air is flowed from the air chamber 32 to the airfoil cavities through the airfoil orifices 52. Although not specifically shown, the cooling flow may be discharged from the cavities to the working medium flowpath 12 or any adjacent region of sufficiently low pressure.

Each platform cavity 46 lies between adjacent nozzle guide vanes 34 and is pressurized to prevent the circulation of working medium gas beneath the platforms 40. The pressure within the platform cavities need be only slightly higher than the local pressure of the working medium gases to prevent recirculation. Accordingly, platform orifices 50 in one embodiment are sized to admit only limited amounts of cooling air to the platform cavities in order to prevent excessive leakage of air between adjacent platforms. In alternative embodiments the platform cavities are supplied with relatively low pressure air from any suitable source and may incorporate a mechanical type sealing means between the vanes.

Those skilled in the art will recognize that the alternating platform and airfoil cavity construction of the present invention is particularly advantageous where impingement cooling of the guide vanes is employed. As has been discussed above, a substantial pressure differential is required between the cooling air and the working medium gases in order to accelerate the air to impingement velocities. If this same pressure differential were applied between adjacent vanes substantial leakage would occur and performance would be reduced. Regardless of the precise construction, an important feature to be realized is that two cooling pressures and even two cooling air sources can be advantageously utilized in the guide vane region to minimize the wasteful leakage of cooling air.

Although the invention has been shown in one preferred embodiment at the location of the second stage vanes, it should be understood by those skilled in the art that many of the concepts shown are equally applicable to any coolable turbine stage. Additionally, it should be noted that other various changes and omissions in the form and detail thereof may be made therein without departing from the spirit and the scope of the invention.

Having thus described a typical embodiment of our invention, that which we claim as new and desire to secure by Letters Patent of the United States is:

1. In the turbine section of a gas turbine engine of the type having a plurality of nozzle guide vanes disposed circumferentially about the engine with the airfoil section of each vane extending radially inward across the path of the working medium gases flowing through the engine, and an annular cooling air chamber located radially outward of the guide vanes between a turbine case and a deformable ring having an upstream portion encased by supporting structure, wherein the improvement comprises:

means, which are operative in response to pressure forces exerted by the working medium gases on the airfoil sections of the vanes during operation of the engine, for preventing the leakage of cooling air around the upstream portion of the ring by deforming the ring against the supporting structure.

2. The invention according to claim 1 wherein the upstream portion of the deformable ring has a U-shaped contour and wherein said means for preventing the leakage of cooling air around the upstream portion comprises:

an upstream rail extending radially inward from the case about the full circumference of the engine and which has an outwardly facing circumferential surface; and a hook which extends from each vane to engage the upstream portion of the ring which is urged against the outwardly facing circumferential flange of the upstream rail in operative response to pressure forces exerted by the working medium gases on the airfoil sections of the vanes during operation of the engine.

3. In the turbine nozzle assembly of a gas turbine engine, the combination comprising:

a case which radially encloses a portion of the turbine section of the engine and which has an upstream rail extending radially inward from the case about the full circumference of the engine and a downstream rail extending radially inward from the case about the full circumference of the engine;

a plurality of nozzle guide vanes each of which has an airfoil section, a hook which engages the upstream rail of the case and a downstream flange which is attached to the downstream rail of the case; and a ring which is trapped at one end between the upstream rail and the hooks and at the other end between the downstream rail and the flange, and which is flexible in response to pressure forces exerted by the working medium on the airfoil sections of the vanes to maintain radial sealing contact between the ring and the upstream rail to form an annular chamber between the case and the ring which is adapted to receive cooling air during operation of the engine.

* * * * *